US006223676B1

(12) United States Patent
Lafountain

(10) Patent No.: US 6,223,676 B1
(45) Date of Patent: May 1, 2001

(54) CONTROL FOR X-STERN VEHICLE

(75) Inventor: Kevin Louis Lafountain, Newport News, VA (US)

(73) Assignee: Newport News Shipbuilding and Dry Dock Company, Newport News, VA (US)

( * ) Notice: Subject to any disclaimer, the term of this patent is extended or adjusted under 35 U.S.C. 154(b) by 0 days.

(21) Appl. No.: 09/447,520

(22) Filed: Nov. 23, 1999

(51) Int. Cl.[7] ..... B63G 8/14
(52) U.S. Cl. ..... 114/330; 114/144 R
(58) Field of Search ..... 114/312, 313, 114/330, 331, 332, 23, 24

(56) References Cited

U.S. PATENT DOCUMENTS

| | | | | |
|---|---|---|---|---|
| 2,654,334 | | 10/1953 | Wheeler . | |
| 3,448,710 | * | 6/1969 | Gaskins | 114/330 |
| 3,757,720 | | 9/1973 | Fischer . | |
| 5,186,117 | | 2/1993 | Stallard, III . | |
| 5,333,570 | * | 8/1994 | DuBois et al. | 114/330 |

* cited by examiner

*Primary Examiner*—Stephen Avila
(74) *Attorney, Agent, or Firm*—Lalos & Keegan

(57) ABSTRACT

A direction control assembly for a vehicle, particularly a submarine, travelling through and below the surface of a fluid medium such as the sea. The vehicle has a body formed with a main axis running fore and aft, a contoured outer surface forming flow lines with the fluid medium and a plurality of planes movably secured relative to and extending out from said surface for contact with the fluid medium to permit and produce rising, diving or turning procedures. A movement control assembly including inner and outer gimbal rings are mounted within the body for selective mutual as well as independent movement. A first operating rod is connected to the outer ring for controlling the mutual movement of both the rings and a second operating rod is connected to the inner ring for moving the inner ring independently of the outer ring. Individual connectors or stock rods are positioned between a selected ring such as the inner ring 38 and each of the planes for moving the planes according to the movement of the selected ring whereby selected movements of either or both of the rings move the planes for directing the travel of the vehicle.

53 Claims, 6 Drawing Sheets

CONTROL FOR X-STERN VEHICLE

BACKGROUND OF THE INVENTION

This invention is related to an apparatus and method for controlling the direction of a vehicle travelling through a fluid medium.

More particularly this invention constitutes a unique method and apparatus for actuating the aft control surfaces of a submarine with X-shaped empennage.

Most modern military submarines have a hull form that at least approximates an axisymmetric body of revolution. Most of these have four control surfaces at the stern for steering the vessel, that is, for making it turn left or right—the rudder—or rise or dive—diving plane—or a combination of both. In turn, in most modern submarines these control surfaces are in cruciform. That is, the rise-dive surfaces are generally in the same plane as the horizontal plane through the centerline of the vessel, and the turning surfaces are in the same plane as the vertical plane through the centerline. Thus, the control surfaces are generally in the form of a Greek cross.

In most cases the two rudder planes are yoked together, and the two diving planes are yoked together. Because of this yoking, each pair of control surfaces is operated by a single actuating rod. Thus, one rod turns the ship, and the other rod causes the ship to rise or dive.

It is known that arranging the control surfaces or planes of a submarine in an X configuration has certain advantages. In this form, the control surfaces are in the form of an X. Unlike cruciform designs, X-stern designs utilize all four planes as part of any maneuver. Therefore, an X-stern design enjoys more maneuvering force per unit of control surface area than cruciform designs. X-stern ships can be designed with smaller control surfaces while maintaining maneuvering envelopes comparable to cruciform ships with larger control surfaces. Smaller control surfaces obviously have less drag, but may also be quieter—a very important factor today for a submarine.

The submarine USS ALBACORE had an X-stern configuration where the opposite control surfaces were yoked together. Australian submarines of the recent COLLINS class have X-stern configurations, but the control surfaces are not yoked together and each of the four surfaces has its own actuator. These are two examples of the current known methods of actuating X-sterns. In both cases, the control system for the operating rods is more complicated than that aboard a cruciform ship. In a cruciform ship, if the helmsman wants to turn the ship, the control system commands the rudder operating rod to extend or retract. If a change in depth is required, the control system commands the diving operating rod to extend or retract. In both X-stern designs, the control system commands every operating rod to move in one direction or the other, for any maneuver. Controlling these coordinated operating rod movements is a complex task that can be accomplished with a computer. However, manual coordination of the operating rods, in the event of a computer casualty, is difficult.

Usually the turning axes of the control surfaces are perpendicular to the ship's centerline at the stern. In this configuration, yoking of the two planes on opposite sides of the ship is an option. Some X-stern configurations require that the turning axes of the control surfaces be tilted such that they are not perpendicular to the ship's centerline. In this case, the control surfaces cannot be yoked, since no two turning axes are collinear. For these designs, the only current method of actuation is to use four separate operating rods.

U.S. Pat. No. 3,757,720 gives some idea of the stern arrangement of a submarine. FIG. 2 of the patent shows the mechanism in the stern necessary to actuate the diving planes, including an additional mechanism to actuate a smaller control surface as part of the main surface. Another mechanism of the same type would be required to do the same for the rudder surfaces.

U.S. Pat. No. 2,654,334 shows a torpedo with four control surfaces. However, they are in cruciform and have actuating rods 29 and 32 and a control rod 26.

U.S. Pat. No. 5,186,117 shows an altogether different steering system for a submarine mounted at the bow; this patent is assigned to the assignee of the present invention.

An X-stern control surface actuation mechanism that requires only two and not four operating rods whether the planes on control surfaces are yoked or not is not known in the prior art but offers the following benefits:

a. The space in the stern of most submarines is filled with propulsion shafting and bearings, other equipment and piping, as well as for the control surface actuating mechanisms. Minimizing the number of control rods penetrating this space is highly desirable.

b. The operating rods would operate as they would be in a cruciform design. In other words, one rod would cause the ship to turn and the other rod would cause the ship to rise or dive. This would simplify the control system for the operating rods, and make manual operation of the operating rods as simple as it is in a cruciform design.

DESCRIPTION OF THE PREFERRED EMBODIMENT

Figure 1:
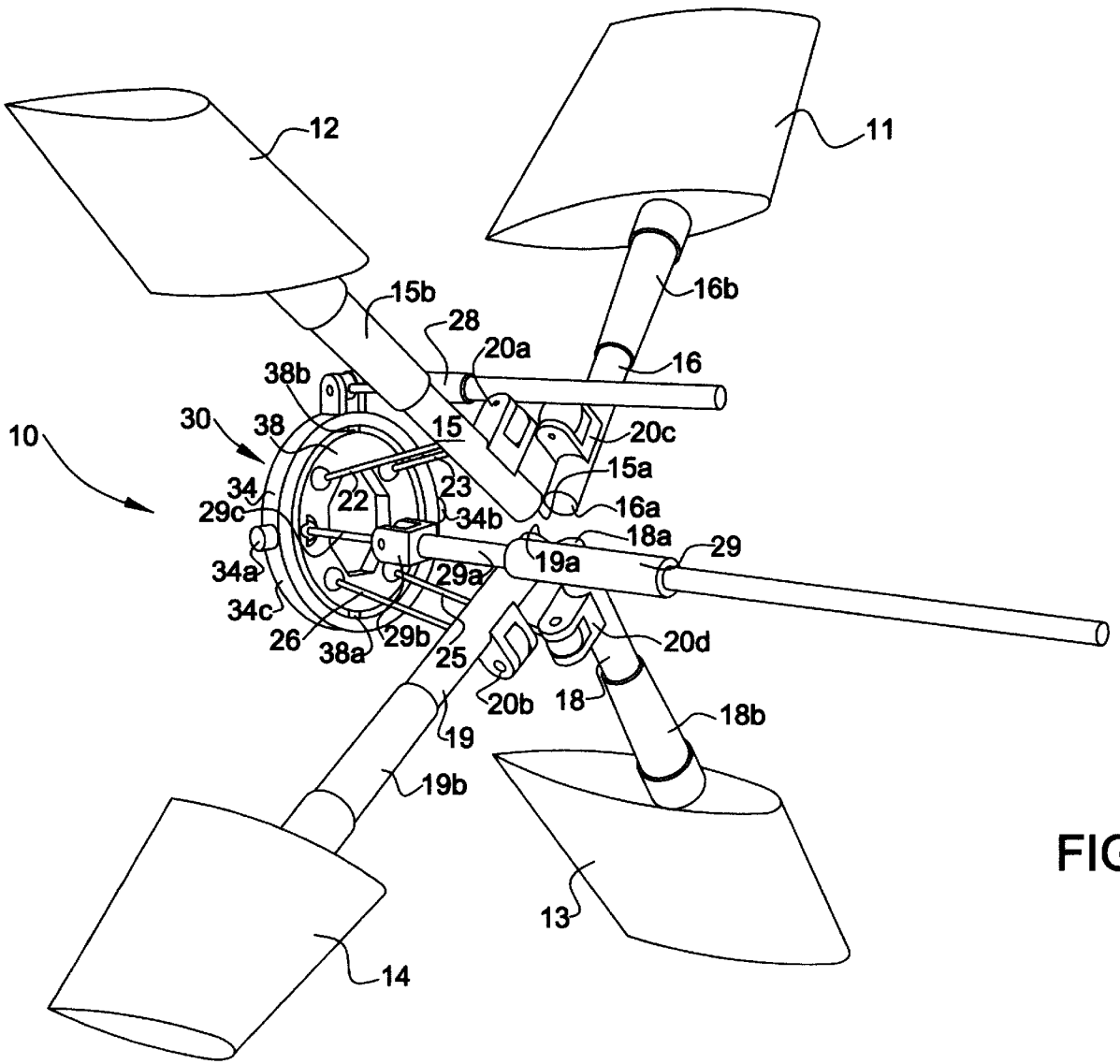
FIG. 1 is a perspective view partly broken away showing the X-tail configuration of the planes along with the diving operating rod and steering operating rod as well as the inner and outer gimbal rings.

FIG. 1 shows the essential elements of the invention positioned as they would be in the stern of a vessel such as a submarine, shown at 10. The parts of the submarine not directly pertinent to an understanding of the invention are omitted.

Planes or control surfaces 12, 14 on the right (starboard) side and 11, 13 on the left (port) side of the longitudinal centerline of the submarine are located outside the submarine at the stern for contact with the sea. These planes are of conventional shape and design but it is their manipulation and the apparatus for controlling the direction of the submarine that are the novel features of the present invention.

The planes 12, 14, 11 & 13 move by virtue of the rotation of their solid cylindrical stocks 15, 19, 16, and 18 respectively to which they are secured. The rotation of the stocks and their planes through a limited arc of motion produces turning moments that cause the submarine to move up or down, right or left, or a combination thereof as in rising or diving turns of the submarine. The stocks are rotatably secured at ends 15*a*, 19*a*, 16*a*, and 18*a*, respectively to the submarine internal structure by means of suitable bearings and seals, not shown. Also at the locations 15*b*, 16*b*, 18*b*, and 19*b*, as shown in FIG. 1, these stocks are rotatably secured at their respective locations through the ship's hull H as shown for one instance at 16*c* in FIG. 7. Similar securings would be accorded stocks 15, 18 and 19 all using conventional through the hull bearings and seals.

Stocks 15, 19 and 16, 18 are rotated about their longitudinal axis by the action of stock rods 22, 26, 23 and 25 connected at their forward ends to their respective stocks 15, 19, 16 and 18 by being pivotally connected to protruding lever arms 20*a*, 20*b*, 20*c*, and 20*d* respectively. Each of these lever arms 20*a*–20*d* is secured at its inboard ends to its respective stocks and pivotally receive its respective stock rods in a manner such that substantially longitudinal movement of the stock rods produces rotational movements of the individual stocks and therefore the planes 12, 14, 11, and 13 respectively.

Figure 2:
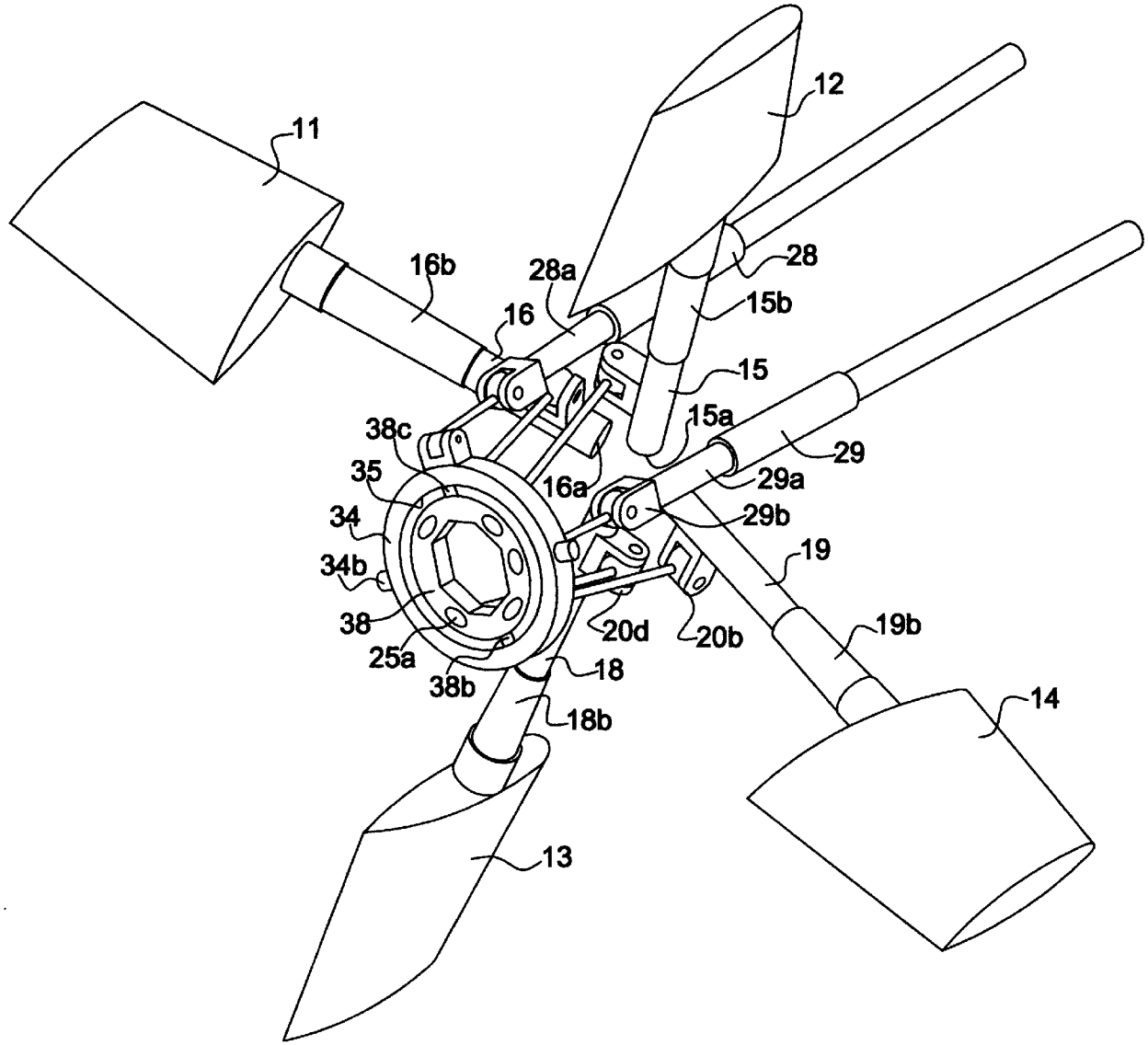
FIG. 2 is a perspective view of the X-tail configuration taken aft and looking forward and showing the aft side of the inner and outer rings and the position of the planes in an X-tail configuration.
Figure 3:
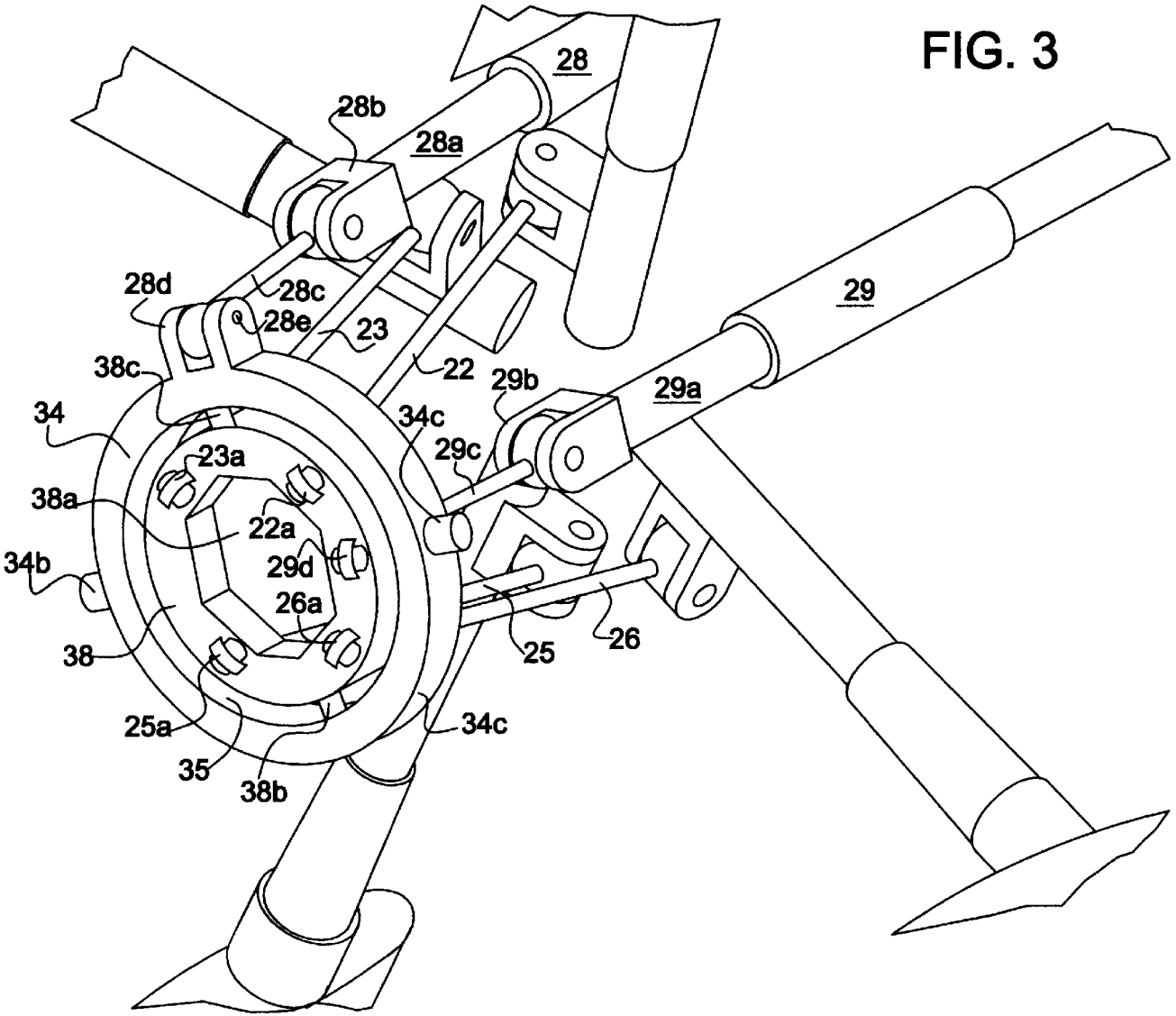
FIG. 3 is a perspective view very similar to that of FIG. 2 but on a larger scale showing in greater detail the spherical connections of the stock connecting rods and the diving and steering operating rods to the outer gimbal ring and the inner gimbal ring.

As best shown in FIGS. 1, 2, and 3, these stock rods 22, 26, 23 and 25 are connected at their rearward ends to a movement control assembly or gimbal ring assembly shown generally at 30. The gimbal ring assembly 30 is composed of an outer gimbal ring 34 and inner gimbal ring 38. The gimbal ring assembly also includes a pair of radially opposed trunnions 34*a* and 34*b* secured to the outer periphery 34*c* of the outer gimbal ring. These trunnions 34*a* and 34*b* mount the gimbal ring assembly 30 in a pivotal arrangement, not shown, within the interior of the submarine, all in a conventional manner. Pivotally secured to the internal surface 35 of outer gimbal ring is inner gimbal ring 38. Inner gimbal ring has a cutout center shown at 38*a* of FIG. 3 and is also provided with a pair of radially opposed trunnions 38*b* and 38*c* that are generally positioned along an axis that is transverse to the generally horizontal axis of the trunnions 34*a* and 34*b* of the outer gimbal ring. It should be understood that, as shown, the gimbal rings are arranged such that the axes of the mounting trunnions 34*a*, 34*b*, 38*b* and 38*c* are orthogonally positioned relative to each other, however, there is no reason why other angular arrangements relative to each other or to the longitudinal axis (C/L) of the submarine could not be used to achieve the same or similar purpose or function in the present invention.

As shown in FIG. 1 and particularly in FIG. 3, the stock rods 22, 26, 23 and 25 are pivotally secured to the inner gimbal ring by spherical rod ending bearings 22*a*, 26*a*, 23*a* and 25*a* respectively or by any other conventional arrangement that permits the degree of movement necessary. Accordingly, stock rods 22, 26, 23 and 25 are moved substantially longitudinally by the combined or independent movements of outer gimbal ring 34 and inner gimbal ring 38. Inner gimbal ring 38 pivots about trunnions 38*a* and 38*b* on an axis that, for example, is essentially vertical, as shown, with respect to the centerline C/L of the submarine. As stated, outer gimbal ring 34 is secured to the submarine structure by means of the trunnions or outer ring bearings 34*a* and 34*b* but pivots on an axis essentially horizontal with respect to the centerline C/L of the submarine. But, as previously stated, these angular arrangements are not critical and can be changed to achieve the same or similar purpose or function.

Diving operating rod 28 and steering operating rod 29 are connected to the gimbal ring assembly 30 to independently or together rotate the respective gimbal rings about their respective axis. As shown, diving operating rod 28 is a cylindrical linear activator and includes connecting rod 28*a* that is extensible in any conventional manner from diving operating rod 28. At the rearward end of the connecting rod 28*a* is pivot connector 28*b* that pivotally receives elongated diving operating rod extension 28*c* for pivotal movement within pivot mount 28*d*. The pivotal connection between the diving operating rod extension 28*c* and the pivot mount 28*d* is conventional allowing the diving operating rod extension 28*c* to pivot about axis 28*e*.

In a similar manner, steering operating rod 29 is shown also to be a cylindrical linear activator and includes connecting rod 29*a*, pivot connector 29*b* and steering operating rod extension 29*c* for connection at the spherical rod end bearing 29*d*. The spherical rod end bearing 29*d* is similar to the spherical bearing arrangements of 22*a*, 23*a*, 25*a* and 26*a*, all of which are secured to the inner gimbal ring 38. Again, it is to be understood that the functions and the respective connections of the outer and inner gimbal rings 34 and 38 may be reversed from that shown and described without departing from the scope of the present invention.

It is also within the purview of the present invention for the gimbal ring 30 to be activated from the rear or the side rather than from a forward position. Also, conventional rotary activators may be substituted for each of the cylindrical linear activator operating rods 28 and 29.

Figures 6, 7:
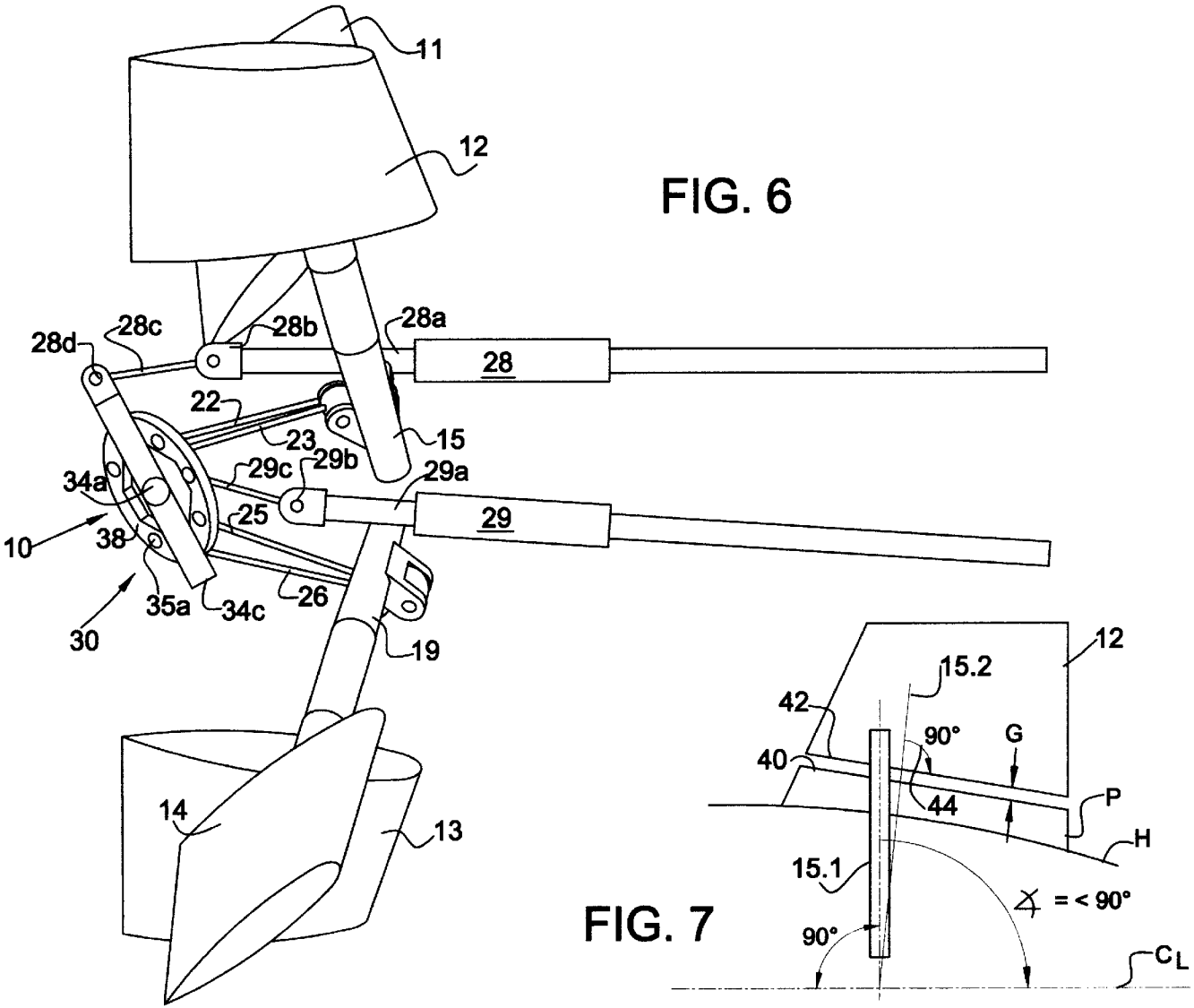
FIG. 6 is a perspective view showing each of the four planes in a position for the vessel to take a diving turn and illustrating the position of the outer ring and the inner ring as they have been moved by the diving operating rod and the steering operating rod respectively.
FIG. 7 is a schematic view partly broken away illustrating the position of the stock and plane relative to the pedestal and the ship's hull. Also illustrated in phantom lines is an alternate embodiment wherein the stock is angled relative to the main axis of the ship at an angle less than 90° but is substantially perpendicular to the contoured surface of the ship.

Referring to FIG. 7, there is shown one of the control surfaces or planes 12 that is rotatable by its stock 15 that is shown to be perpendicular to the C/L of the submarine as it passes through the hull H and the pedestal P that protrudes out of the hull H. The pedestal P has a upper surface 40 that is coextensive and substantially congruent with the lower surface 42 of the plane 12 to produce therebetween a gap G. The magnitude of the gap G is important, as well as the alignment of the gap for the performance of the submarine. For instance, it is desirable to have the plane of the gap G substantially parallel to the flow lines of the hull H, generally as shown in FIG. 7. This minimizes the magnitude of the spacing that forms the gap G, which means lower flow noise and less drag as the submarine traverses the water.

If the stock 15 is perpendicular to the main axis or C/L as shown in the position depicted at 15.1 in FIG. 7, the gap G must be larger in order to accommodate the transverse movement of the plane 12 as it rotates about an axis that is not perpendicular to the plane of the gap G. It should be apparent that the gap has to be larger if the position of the stock is as shown at 15.1 because the movable plane 12 has a finite thickness. As it rotates with respect to the pedestal P, the outer edges of the plane would foul the pedestal if the gap G between the plane 12 and the pedestal P were not large enough. Accordingly, it is preferred that the angle of each of these stocks, such as the example shown in FIG. 7, be lessened with respect to the C/L of the submarine so that the stock is perpendicular to the plane of the gap G, as shown at 44 and therefore at an acute angle with the C/L of the submarine. The magnitude of the acute angle is variable depending upon the magnitude of the gap G and also is variable depending upon the degree of plane rotation. Thus in sum, it may be stated that the stocks of the planes are preferably substantially perpendicular to the flow lines of the hull H at the point that they protrude from the hull H so that they are also substantially parallel to the plane of the gap G to achieve the purpose of the present invention.

FIG. 7 along with the foregoing description, illustrate one of the novel benefits of the present invention in that now only two operating rods, rather than the four operating rods of the prior art discussed above, may be utilized to operate the control surfaces or planes having their turning axes tilted from perpendicular to the ship's C/L.

For an understanding of the operation of the submarine and the mechanism that controls the movement of the X-tail arrangement, the following description is set forth. FIGS. 1 and 3 depict the positioning of the planes 11, 12, 13, and 14 in a neutral position for straight ahead (cruising) direction of the submarine. In such a position, the gimbal ring assembly 30 and particularly outer gimbal ring 34 and inner ring 38 are in a common plane and that plane is essentially perpendicular to the C/L of the submarine as is apparent in the view from the rear of the submarine. FIG. 3 shows this common plane arrangement of both the outer gimbal ring 34 and the inner gimbal ring 38.

Figure 5:
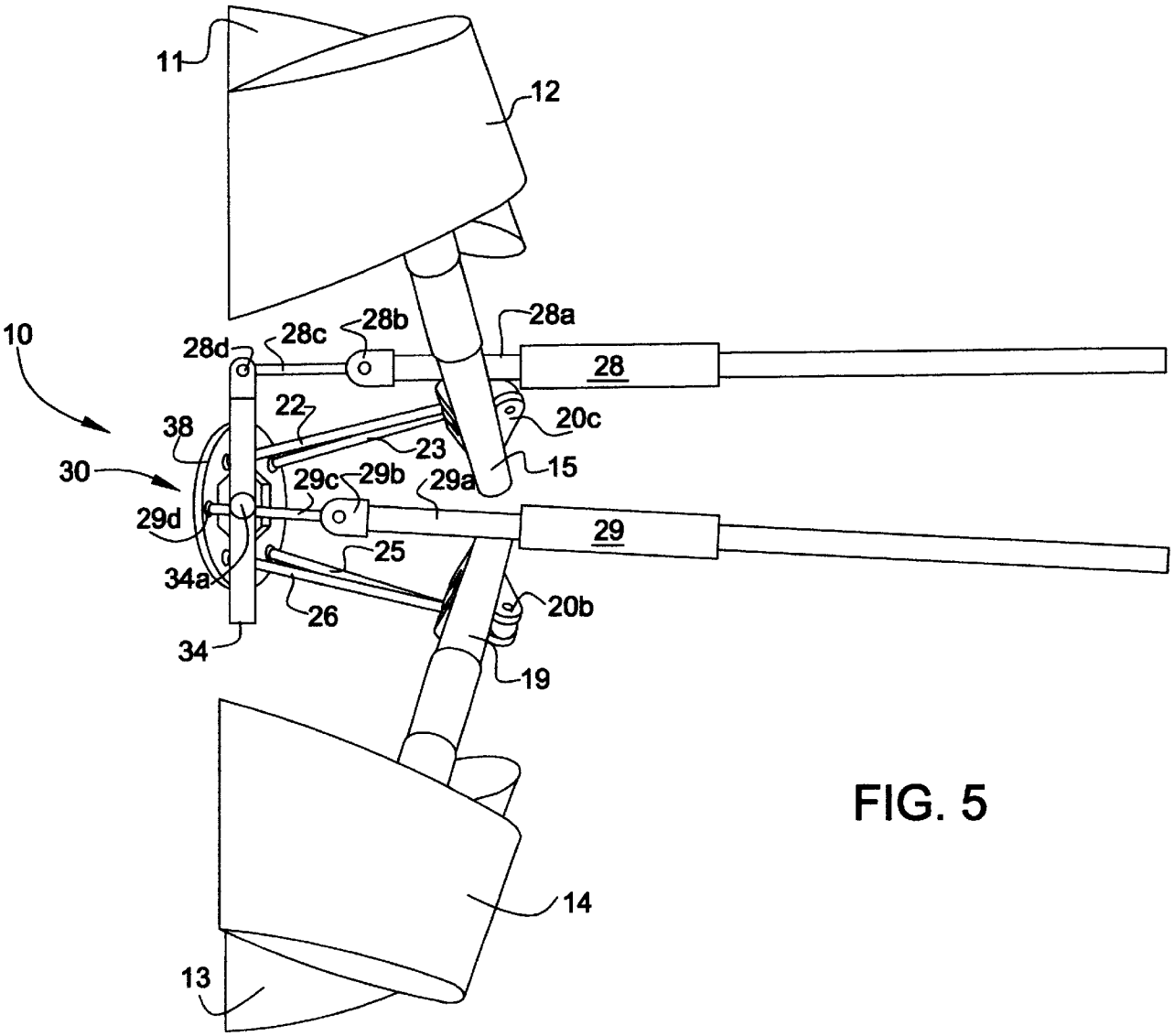
FIG. 5 is a perspective view of all four planes positioned for a turn of the vessel and illustrating particularly the movement of the inner ring relative to the outer ring.

In order to steer the submarine, steering operating rod 29 extends steering connector rod 29*a* pivot connector 29*b* and steering operating rod extension 29*c* rearwardly to the spherical rod end bearing 29*d* as it is connected to the inner gimbal 38. Such extension rotates the inner gimbal ring 38 clockwise about its vertical axis extending through opposed trunnions 38*b* and 38*c* as shown in FIG. 5. In this turning maneuver, it should be noted that outer gimbal ring 34 remains stationary and essentially in a vertical plane again as shown in FIG. 5. The movement of the steering operating rod 29 not only moves the inner gimbal ring 38 but also pushes stock rods 23 and 25 in a forward direction and simultaneously pulls stock rods 22 and 26 in a rearward direction. This movement of the inner gimbal ring 38 and the movement of the stock rods rotates the four stocks 15, 19 and 16, 18 through their respective protruding lever arms 20*a* through 20*d* respectively and ultimately rotates the planes 12, 14 and 11, 13 respectively into the position shown clearly in FIG. 5 to produce turning moments on the stern of the submarine. It is obvious, in a reverse manner, to steer the submarine in the opposite direction, steering operating rod 29 is retracted to rotate the inner gimbal ring 38 in a counter clockwise direction about its vertical axis so as to reverse the previously described movement and move the planes 12, 14, 11, and 13 in the opposite direction.

Figure 4:
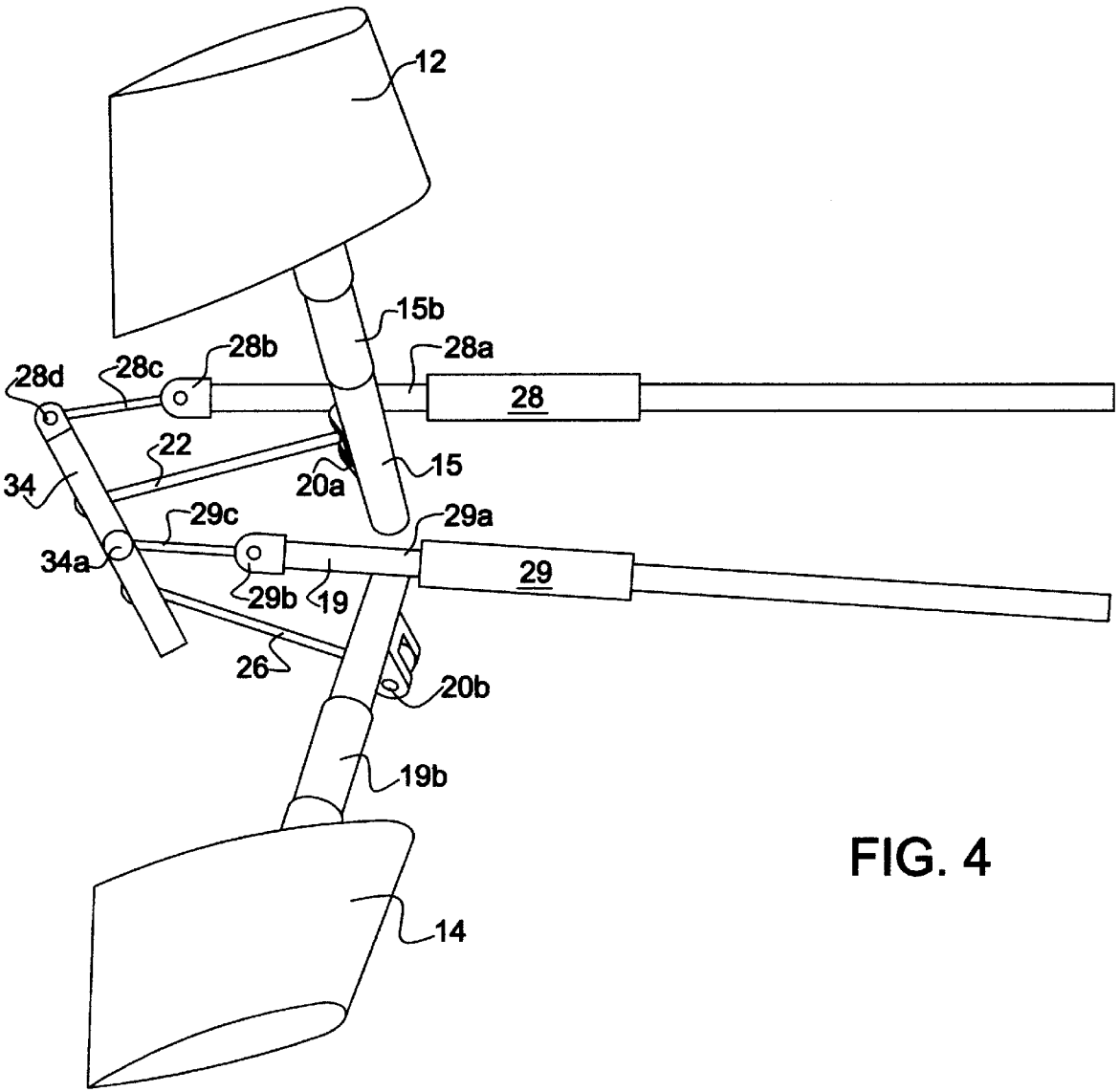
FIG. 4 is a perspective view showing only one pair of planes and their position during a dive of the vessel and also showing the positioning of the movement control assembly formed by the inner and outer gimbal rings.

When it is desired to dive the submarine, the position of the diving mechanism is illustrated in FIG. 4. The diving operating rod 28 extends diving connecting rod 28*a* rearwardly along with pivot connector 28*b* and diving operating rod extension 28*c* to achieve the pivotal movement about pivot mount 28*d* and therefore rotate outer gimbal ring 34 about its horizontal axis formed by outer ring bearings 34*a* and 34*b* of which only outer ring bearing 34*a* is shown in FIG. 4. This action and pivotal movement of the outer gimbal ring 34 pulls upper stock rods 22 and 23 rearwardly. In this view from the right side of the submarine, only planes 12 and 14 are illustrated along with their accompanying manipulating elements. Stock rod 22 thus rotates stock 15 through protruding lever arm 20*a* and at the same time stock rods 26 and 25 similarly are moved forwardly to rotate their respective planes. For clarity, only plane 14 and its respective stock 19 is shown. With the rotation of all four stocks and their respective planes, a powerful diving moment is placed upon the stern of the submarine for it to dive. Obviously, the opposite movement of the diving operating rod 28 will cause the submarine to rise. Here it is to be noted that during the diving maneuvers inner gimbal ring 38 remains within the plane of the outer gimbal ring 34 so that no steering motions are created.

Should, however, it be desirable to produce both diving and turning of the submarine, FIG. 6 illustrates the positioning of the gimbal ring assembly 30 with its outer gimbal ring 34 and the inner gimbal ring 38 along with each of the planes 12, 14, 11 and 13 to create a diving turn of the submarine. To effect such a diving turn, the diving operating rod 28 operates in a manner as described for FIG. 4 to tilt or rotate the outer gimbal ring 34 about its horizontal axis, however, at the same time, steering operating rod 29 is retracted forwardly to produce a rotation of the inner gimbal ring 38 in a counter clockwise direction relative to its axis within the outer gimbal ring. This plural action produces movement of the stocks and their respective planes to the position shown in FIG. 6. It should be noted that the steering movement illustrated in FIG. 6 is the opposite of that represented by the turn illustrated in FIG. 5. This should be apparent from the relative positions of the end of the steering operating rod 29 when viewed in each of the FIGS. 5 and 6.

It should be understood that the diving operating rod 28 and the steering operating rod 29 could be actuated by ordinary double acting hydraulic cylinders, one for each operating rod or by any other means conventional in the art.

It is important to understand that a feature of this invention is that all four planes or controlled surfaces 12, 14, 11 and 13 produce both steering and rise or dive moments simultaneously. The four planes are not activated independently but act together. In a military vessel such as a submarine, it is significant that all the controlled surfaces or planes are connected by the mechanism described above so that it is much less likely that any single plane, through equipment malfunction or damage could produce moments that would unpredictably negate or reinforce those of the other surfaces. It is also to be noted that the control system described for this invention is simpler and less complex than in a submarine using separate control rods for each plane or controlled surface.

It is important to understand that the scope of the invention described above is only to be limited by the scope of the following claims.

I claim:

1. A direction control assembly for a vehicle travelling through a fluid medium, said vehicle having a body formed with a main axis and contoured surface forming flow lines with said fluid medium, a plurality of planes movably secured relative to and extending out from said surface in an X-shaped empennage for contact with said fluid medium, a movement control assembly mounted within said body, said movement control assembly including a first portion thereof and a second portion mounted on at least one location substantially within said movement control assembly for selective independent movement relative to said first portion and selective mutual movement with said first portion, a first operating means connected to said movement control assembly for controlling said mutual movement of said first portion and said second portion and for moving each of said planes, a second operating means connected to movement control assembly for providing relative movement between said second portion and said first portion and for moving each of said planes, an individual connector between said movement control assembly and each of said planes for moving each of said planes within said fluid medium upon movement of said second portion, whereby all movements of either of said first and said second portions move each of the planes for directing the entire of said vehicle.

2. The assembly of claim 1 including, said first portion and said second portions being pivotable rings.

3. The assembly of claim 1 including, said first operating means being a diving operating rod and said second operating means being a steering operating rod.

4. The assembly of claim 1 including, said first portion being mounted for pivotal movement about a first axis, said second portion being mounted for pivotal movement about both said first axis and a second axis.

5. The assembly of claim 1 including, said first portion being mounted for pivotal movement about a pivotal axis within a plane perpendicular to said main axis of said vehicle, said second portion being pivotally mounted and being mounted about an axis substantially perpendicular to said pivotal axis.

6. The assembly of claim 1 including, an individual elongated stock mounted within said body for pivoting each said plane.

7. The assembly of claim 1 including, said first operating means being extensible and being secured to the outer periphery of said first portion.

8. The assembly of claim 1 including, said second operating means being extensible and being secured to said second portion at a position remote from said location for mounting said second portion.

9. The assembly of claim 2 including, an individual elongated stock mounted within said body for pivoting each said plane, and each said connector being secured to said individual stock.

10. The assembly of claim 9 including, each said connector being connected at one end to said second portion and at the other end to said stock for rotation of said stock and said respective plane.

11. The assembly of claim 1 including, said first portion being a pivotable outer ring and said second portion being an inner ring pivotably mounted to said outer ring, and said first operating means being a diving operating rod and said second operating means being a steering operating rod.

12. The assembly of claim 1 including, said first portion being mounted for pivotal movement about a first axis, said second portion being mounted for pivotal movement about both said first axis and a second axis, and said first portion being a pivotable outer ring and said second portion being an inner ring pivotably mounted to said outer ring.

13. The assembly of claim 1 including, said first portion being mounted for pivotal movement about a pivotal axis perpendicular to said main axis of said vehicle, said second portion being pivotally mounted and being mounted about an axis substantially perpendicular to said pivotal axis, and said first portion and said second portion being pivotable rings.

14. The assembly of claim 1 including, said first portion being a pivotable outer ring and said second portion being an inner ring pivotably mounted to said outer ring, and an individual elongated stock mounted within said body and extending out to and pivotally connected to each said plane.

15. The assembly of claim 1 including, said first portion being mounted for pivotal movement about a first axis, said second portion being mounted for pivotal movement about both said first axis and a second axis, said first portion and said second portion being pivotable rings, said first operating means being a diving operating rod and said second operating means being a steering operating rod.

16. The assembly of claim 1 including, said first portion being a pivotable outer ring and said second portion being an inner ring pivotably mounted to said outer ring, and an individual elongated stock mounted within said body for pivoting each said plane.

17. The assembly of claim 1 including, said first portion being mounted for pivotal movement about a first axis, said second portion being mounted for pivotal movement about both said first axis and a second axis, and an individual elongated stock mounted within said body for pivoting each said plane.

18. The assembly of claim 1 including, said first portion being mounted for pivotal movement about a first axis, said second portion being mounted for pivotal movement about both said first axis and a second axis, said first operating means being extensible and being secured to the outer periphery of said first portion, said second operating means being extensible and being secured to said second portion at a position remote from said location for mounting said second portion, and said first portion being a pivotable outer ring and said second portion being an inner ring pivotably mounted to said outer ring.

19. The assembly of claim 1 including, said first portion being mounted for pivotal movement about a first axis, said second portion being mounted for pivotal movement about both said first axis and a second axis, said first operating means being extensible and being secured to the outer periphery of said first portion, said second operating means being extensible and being secured to said second portion at a position remote from said location for mounting said second portion, and an individual elongated stock mounted within said body for pivoting each said plane, and each said connector being secured to said individual stock.

20. The assembly of claim 1 including, an individual elongated stock mounted within said body for pivoting each said plane, each said connector being connected at one end to said second portion and at the other end to said stock for rotation of said stock and said respective plane, and said first portion being a pivotable outer ring and said second portion being an inner ring pivotably mounted to said outer ring.

21. The assembly of claim 1 including, said first portion being mounted for pivotal movement about a pivotal axis within a plane perpendicular to said main axis of said vehicle, said second portion being pivotally mounted and being mounted about an axis substantially perpendicular to said pivotal axis, an individual elongated stock mounted within said body for pivoting each said plane, and said first portion being a pivotable outer ring and said second portion being an inner ring pivotably mounted to said outer ring.

22. The assembly of claim 1 including, said first portion being mounted for pivotal movement about a pivotal axis within a plane perpendicular to said main axis of said vehicle, said second portion being pivotally mounted and being mounted about an axis substantially perpendicular to said pivotal axis, said first operating means being extensible and being secured to the outer periphery of said first portion, said second operating means being extensible and being secured to said second portion at a position remote from said location for mounting said second portion, and said first portion being a pivotable outer ring and said second portion being an inner ring pivotably mounted to said outer ring.

23. The assembly of claim 1 including, said first portion being mounted for pivotal movement about an axis within a plane perpendicular to said main axis of said vehicle, said second portion being pivotally mounted and being mounted about an axis sustantially perpendicular to said pivotal axis, said first operating means being extensible and being secured to the outer periphery of said first portion, said second operating means being extensible and being secured to said second portion at a position remote from said location for mounting said second portion, an individual stock mounted within said body for pivoting each said plane, each said connector being secured to said individual stock, and said first portion being a pivotable outer ring and said second portion being an inner ring pivotally mounted to said outer ring.

24. The assembly of claim 1 including, said first portion being mounted for pivotal movement about a substantially horizontal axis within a vertical plane perpendicular to said main axis of said vehicle, said second portion being pivotally mounted within said first portion and being mounted about an axis substantially perpendicular to said horizontal axis, said first operating means being extensible and being secured to the outer periphery of said first portion, said second operating means being extensible and being secured to said second portion at a position remote from said location for mounting said second portion, an individual elongated stock mounted within said body for pivoting each said plane, each said connector being connected at one end to said second portion and at the other end to said stock for rotation of said stock and said respective plane, and said first portion being a pivotable outer ring and said second portion being an inner ring pivotably mounted to said outer ring.

25. The assembly of claim 1 including, said planes being an empennage in an X-arrangement.

26. The assembly of claim 1 including, an individual elongated stock mounted within said body for pivoting each said plane, and said planes being an empennage in an X-arrangement.

27. The assembly of claim 1 including, said first portion being mounted for pivotal movement about a substantially horizontal axis within a vertical plane perpendicular to said main axis of said vehicle, said second portion being pivotally mounted within said first portion and being mounted about an axis substantially perpendicular to said horizontal axis, said first operating means being extensible and being secured to the outer periphery of said first portion, said second operating means being extensible and being secured to said second portion at a position remote from said location for mounting said second portion, an individual elongated stock mounted within said body and extending out to and pivotally connected to each said plane, each said connector being secured to said individual stock, and said first portion being a pivotable outer ring and said second portion being an inner ring pivotably mounted to said outr ring.

28. The assembly of claim 1 including, said first portion being mounted for pivotal movement about a substantially horizontal axis within a vertical plane perpendicular to said main axis of said vehicle, said second portion being pivotally mounted within said first portion and being mounted about an axis substantially perpendicular to said horizontal axis, said first operating means being extensible and being secured to the outer periphery of said first portion, said second operating means being extensible and being secured to said second portion at a position remote from said location for mounting said second portion, an individual elongated stock mounted within said body for pivoting each said plane, each said connector being connected at one end to said second portion and at the other end to said stock for rotation of said stock and said respective plane, said first portion being a pivotable outer ring and said second portion being an inner ring pivotably mounted to said outer ring, and said planes being an empennage in an X-arrangement.

29. A direction control assembly for a vehicle travelling through a fluid medium, said vehicle having a body formed with a main axis and contoured surface forming flow lines with said fluid medium, a plurality of planes movably secured relative to and extending out from said surface for contact with said fluid medium, a movement control assembly mounted within said body for controlling the direction of said vehicle, said movement control assembly including a pair of rings, a first operating means and a second operating means connected respectively to said movement control assembly for selected movement of said rings, connectors secured between one of said rings and each of said planes whereby to control the movement of said planes for directing the vehicle through the medium.

30. The assembly of claim 29 including, said rings being pivotally mounted.

31. The assembly of claim 30 including, one of said rings being mounted within the other of said rings.

32. The assembly of claim 29 including, said first operating means being connected to one of said rings for controlling mutual movement of both of said rings and said second operating means being connected to the other of said rings for producing relative movement between said rings.

33. The assembly of claim 32 including, both said first and second operating means being connected to one of said rings.

34. The assembly of claim 32 including, the said other of said rings being pivotally mounted within the said one of said rings.

35. The assembly of claim 32 including, said rings being an inner ring pivotally secured within an outer ring pivotally mounted within said vessel, said connectors being secured to the inner ring at one end.

36. method for controlling the direction of movement of a vehicle travelling through a fluid medium, providing a vehicle having a main axis and a contoured surface, providing a plurality of planes forming a X-shaped empennage, providing a first operating rod and a second operating rod connected to said planes for controlling all said movement, turning said vehicle by moving said second operating rod, changing the vertical position of said vehicle to rise or dive by moving said first operating rod, and whereby said first and said second operating rods control the entire direction of movement of the vehicle.

37. The method of claim 36 including, providing a pair of mutually pivotable rings pivotally secured within said vehicle, pivoting one ring of said pair by movement of said first operating rod to change the vertical position of the vehicle and pivoting the other ring of said pair by movement of said second operating rod to turn the vehicle.

38. A direction control assembly for a vehicle traveling through a fluid medium, said vehicle having a body formed with a main axis and contoured surface forming flow lines with said fluid medium, a plurality of planes movably secured relative to and extending out from said surface in an X-shaped empennage for contact with said fluid medium, a movement control assembly mounted within said body, said movement control assembly including a first portion thereof and a second portion mounted on at least one location substantially within said movement control assembly for selective independent movement relative to said first portion and selective mutual movement with said first portion, a first operating means connected to said movement control assembly for controlling said mutual movement of said first portion and said second portion and for moving each of said planes, a second operating means connected to movement control assembly for providing relative movement between said second portion and said first portion and for moving each of said planes, an individual conector between said movement control assembly and each of said planes for moving each of said planes within said fluid medium, whereby any movements of either of said first and said second portions move each of the planes for directing the entire travel of said vehicle.

39. The assembly of claim 38 including, said first portion and said second portions being pivotable rings.

40. The assembly of claim 38 including, said first operating means being a diving operating rod and said second operating means being a steering operating rod.

41. The assembly of claim 38 including, said first portion being mounted for pivotal movement about a first axis, said second portion being mounted for pivotal movement about both said first axis and a second axis.

42. The assembly of claim 38 including, said first portion being mounted for pivotal movement about a pivotal axis within a plane perpendicular to said main axis of said vehicle, said second portion being pivotally mounted and being mounted about an axis substantially perpendicular to said pivotal axis.

43. The assembly of claim 38 including, said first portion being a pivotable outer ring and said second portion being an inner ring pivotably mounted to said outer ring, and said first operating means being a diving operating rod and said second operating means being a steering operating rod.

44. A direction control assembly for a vehicle traveling through a fluid medium, said vehicle having a body formed with a main axis and contoured surface forming flow lines with said fluid medium, a plurality of planes movably secured relative to and extending out from said surface in an X-shaped empennage for contact with said fluid medium, a movement control assembly mounted within said body, said movement control assembly being connected to each of said planes in said X-shaped empennage for moving said planes within said fluid medium, a first operator connected to said movement control assembly for controlling the vertical position of said vehicle and produce a rise or dive by selectively moving each of said planes in said X-shaped empennage, a second operator connected to said movement control assembly for controlling the turning movement of said vehicle by selectively moving each of said planes in said X-shaped empennage, whereby any and all movements of each said first operator and said second operator move each of the planes in said X-shaped empennage for directing the entire travel of said vehicle.

45. The assembly of claim 44 including, said movement control assembly including a first portion thereof and a second portion mounted on at least one location substantially within said movement control assembly for selective independent movement relative to said first portion and selective mutual movement with said first portion, said first portion and said second portions each being a pivotable ring connected to said first and second connectors respectively.

46. The assembly of claim 44 including, said first operator being a diving operating rod and said second operator being a steering operating rod.

47. The assembly of claim 45 including, said first portion being mounted for pivotal movement about a first axis, said second portion being mounted for pivotal movement about both said first axis and a second axis.

48. The assembly of claim 45 including, said first portion being mounted for pivotal movement about a pivotal axis within a plane perpendicular to said main axis of said vehicle, said second portion being pivotally mounted and being mounted about an axis substantially perpendicular to said pivotal axis.

49. The assembly of claim 45 including, said first portion being a pivotable outer ring and said second portion being an inner ring pivotably mounted to said outer ring.

50. The method of claim 36 including, moving each of said planes by said moving of said first operating rod to effect said changing the vertical position of said vehicle.

51. The method of claim 36 including, moving each of said planes by said moving of said second operating rod to effect said turning of said vehicle.

52. The method of claim 36 including, moving each of said planes by said moving of said first operating rod to effect said changing the vertical position of said vehicle, and moving each of said planes by said moving of said second operating rod to effect said turning of said vehicle.

53. The method of claim 36 including, moving each of said planes by said moving of said first operating rod to effect said changing the vertical position of said vehicle, moving each of said planes by said moving of said second operating rod to effect said turning of said vehicle, providing a pair of mutually pivotable rings pivotally secured within said vehicle, pivoting one ring of said pair by movement of said first operating rod to change the vertical position of the vehicle, and pivoting the other ring of said pair by movement of said second operating rod to turn the vehicle.

* * * * *